United States Patent [19]

Pfeiffer et al.

[11] Patent Number: 5,067,636

[45] Date of Patent: Nov. 26, 1991

[54] CONTAINER ASSEMBLY FOR THE TRANSPORT, STORAGE AND DISPENSING OF FLOWABLE MATERIALS

[75] Inventors: Pierre Pfeiffer, Drulingen; Benoit Cheval, Saverne; Paul Sigwalt, Drulingen, all of France

[73] Assignee: Sotralentz S. A., Drulingen, France

[21] Appl. No.: 404,305

[22] Filed: Sep. 7, 1989

[30] Foreign Application Priority Data

Sep. 8, 1988 [DE] Fed. Rep. of Germany ..... 3830487

[51] Int. Cl.[5] ..... B65D 35/56

[52] U.S. Cl. ..... 222/105; 222/185

[58] Field of Search ..... 222/105, 106, 107, 212, 222/183, 185

[56] References Cited

U.S. PATENT DOCUMENTS

| | | | |
|---|---|---|---|
| 2,720,998 | 10/1955 | Potter | 222/107 |
| 3,081,911 | 3/1963 | Scholle | 222/107 |
| 3,112,047 | 11/1963 | Weinreich et al. | 222/107 |
| 3,117,695 | 1/1964 | Cox | 222/107 |
| 3,138,293 | 6/1964 | Roak et al. | 222/107 |
| 3,696,969 | 10/1972 | DeVan et al. | 222/183 |
| 3,837,533 | 9/1974 | Splan | 222/105 |
| 3,945,534 | 3/1976 | Ady | 222/105 |
| 4,098,434 | 7/1978 | Uhlig | 222/212 |
| 4,165,024 | 8/1979 | Oswalt et al. | 222/105 |
| 4,322,018 | 3/1982 | Rutter | 222/107 |
| 4,421,253 | 12/1983 | Croley | 222/105 |
| 4,549,673 | 10/1985 | Kupersmit | 222/105 |
| 4,586,628 | 5/1986 | Nittel | 220/404 |
| 4,771,917 | 9/1988 | Heaps, Jr. et al. | 222/105 |
| 4,919,306 | 4/1990 | Heaps, Jr. et al. | 222/105 |
| 4,960,227 | 10/1990 | Coleman | 222/105 |

FOREIGN PATENT DOCUMENTS

| | | |
|---|---|---|
| 1278335 | 10/1968 | Fed. Rep. of Germany . |
| 2255299 | 5/1974 | Fed. Rep. of Germany . |
| 8807118 | 9/1988 | Fed. Rep. of Germany . |
| 365965 | 1/1963 | Switzerland . |

*Primary Examiner*—Michael S. Huppert
*Assistant Examiner*—Kenneth Bomberg
*Attorney, Agent, or Firm*—Herbert Dubno

[57] ABSTRACT

A container assembly has a load-supporting outer container and a collapsible sack inner container with a hose spigot received in an externally threaded outer spigot of the outer container. A valve is attached to the outer spigot to enable emptying of the inner container which is not connected to the upper wall or filling aperture of the outer container during transport and storage to prevent tearing of the inner container or discharge of the containers of the inner container into the outer container by the transport and storage stresses.

2 Claims, 3 Drawing Sheets

CONTAINER ASSEMBLY FOR THE TRANSPORT, STORAGE AND DISPENSING OF FLOWABLE MATERIALS

FIELD OF THE INVENTION

Our present invention relates to a container assembly for the transport, storage and dispensing of flowable materials, especially liquids and powders. More particularly, the invention relates to a container assembly of the dual container type in which a collapsible inner container is received in a load-supporting outer container.

BACKGROUND OF THE INVENTION

In German Patent Document DE-GM 8807118, there is described a dual container assembly for the purposes described in which the load-bearing outer container is fabricated from thermoplastic material while the inner container is comprised of a blown plastic foil or, as may be more generally referred to herein, plastic sheeting.

The outer container lid has an aperture which is of large caliber or diameter as compared with the diameter or caliber of the spigot, hereinafter referred to as an outlet pipe spigot, formed in the outer container near its base.

The spigot can have an external screwthread for receiving a cap or some other fixture capable of being connected to the container.

When the sack is filled, it conforms generally to the configuration of the outer container and is supported thereby.

In the container units of this kind described in DE-GM 8807118, large volumes are contemplated, i.e. the container unit may have a capacity of 1000 liters or more. The sack allows the outer container to be reused repeatedly in a simple manner and can be disposed of independently of the outer container so that any residues of the material within the inner container or sack can be retained therein for such disposal. Hence contamination of the environment or pollution from residues within the sack can be eliminated and disposal can be assured in accordance with applicable regulations and statutes.

Furthermore, when the inner container or sack is removed or disposed of with any residues, expensive cleaning or contamination of the interior of the outer container is not necessary. Of course, care must be taken to insure that the sack does not leak into the outer container after receiving the liquid or powder filling.

In a container unit as described in German patent Document DE-OS 22 55 299, the outer container is a barrel and the inner container is referred to as an insert bag and is connected to the bung in the barrel lid.

Experience has shown that this system has problems in tearing away of the insert bag from the bunghole and with the possibility that the contents of the container will be discharged into the interior of the barrel.

In a container of another type, namely, a folding container having a passage for the outlet spigot of the inner container (German patent document DE-AS 12 78 335), the inner bag has an outlet spigot disposed in the region at the top of the following container where it passes through the aperture formed at this location and is secured in place so that it can tear or pull away and release material into the outer container.

OBJECTS OF THE INVENTION

It is, therefore, the principal object of the present invention to provide a container unit for the transport, storage and dispensing of flowable materials, especially liquids and powders, which has the advantages of container units described but is free from the drawbacks thereof.

Another object of our invention is to provide a container assembly of the two container type using a collapsible inner sack and a supporting outer container which prevents discharge of the contents of the inner container into the outer container during the stresses normally occurring during transportation and storage.

SUMMARY OF THE INVENTION

These objects and others which will become apparent hereinafter are attained, in accordance with this invention by providing the inner container as a sack or bag composed of blown plastic foil or, more generally, plastic sheeting, with a hose-type spigot which passes through and is connected to the outer edge of the outlet pipe spigot of the load-supporting outer container.

A valve is screwed onto the outlet pipe spigot and can serve for opening and closing the hose spigot of the inner bag and thus can serve for emptying the latter. The sack in the outer container can be completely detached from the upper wall and the filling aperture of the outer container normally provided in this upper wall so that, when the sack is completely or partially filled and stresses are applied, the lack of attachment of the sack in the outer container in any way other than by the attachment of the hose spigot to the outer edge of the outlet pipe spigot of the outer container precludes a tearing phenomenon which may open the inner container in some undesirable manner and discharge its contents into the outer container.

The sack itself can be introduced into the outer container through the large diameter aperture in the upper wall or lid of the container.

According to a feature of the invention, the sack itself has only a single aperture in the form of the aforementioned hose spigot and the sack is filled and emptied through the spigot and, if desired, the valve or some other setting applied to the outlet pipe spigot. In this case, the sack is inserted into the outer container and in its collapsed and possibly evacuated state and then is filled through the outlet pipe spigot and the hose spigot.

In another embodiment of this invention, the sack also has a top filling aperture which can be temporarily connected to the large diameter aperture to the upper wall of the outer container for filling purposes. However, the top filling aperture of the sack is then closed and removed from the latter wall and its large diameter aperture.

More specifically, the container assembly of the invention can comprise:

an outer load-bearing container composed of thermoplastic material and formed with an upper wall having a large-caliber closable aperture affording access into an interior of the outer container, lateral wall means around the interior, a base for the outer container and an outlet pipe spigot formed on the lateral wall means near the base, the outlet pipe spigot being formed with an external screwthread;

an inner container in the form of a collapsible flexible-wall sack composed of a plastic sheet material received in the interior of the outer container and formed with a hose spigot extending through the outlet pipe spigot and secured to an outer edge of the outlet pipe spigot, the sack being fillable with the material and, when filled, conforming to the configuration of the outer container, the container when at least partially filled being free from connection to the aperture and the upper wall; and a valve threaded onto the outlet pipe spigot for opening and closing flow through the hose spigot.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
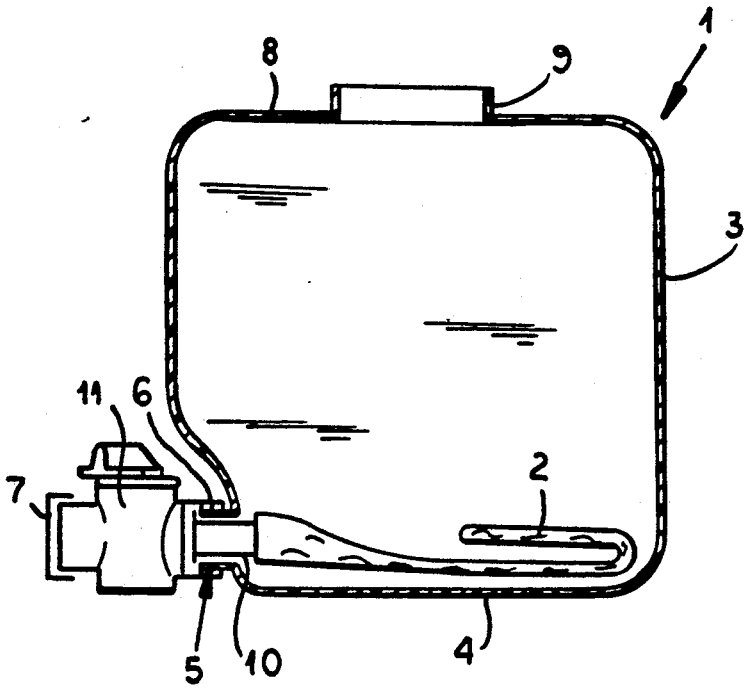
FIG. 1 is a diagrammatic cross sectional view illustrating a first embodiment of the invention showing the inner container or sack in a collapsed and evacuated state.

The container units or assembly shown in the drawing are intended for the transportation and storage of material in liquid or powder form.

Basically, the assembly comprises a load bearing outer container 1 of thermoplastic material and an internal container in the form of a sack made from plastic foil or sheeting, e.g. by a blowing process or by heat sealing a blown foil.

The inner container is shaped to conform substantially to the outer container when the inner container is filled with the flowable material.

The outer container has lateral wall means providing an outer surface 3 and enclosing an interior. The outer surface 3 has an outlet pipe spigot 5 near the base 4 of the outer container. The outlet pipe spigot is of such wall thickness (compare FIG. 6) as to be rigid.

The outlet pipe spigot has, extending from its outer edge 5, an external press screwthread 6.

A cap 7 can be applied to this external screwthread if desired, although generally the cap 7 is applied to a valve 11 which is threaded onto the spigot 5.

Figure 2:
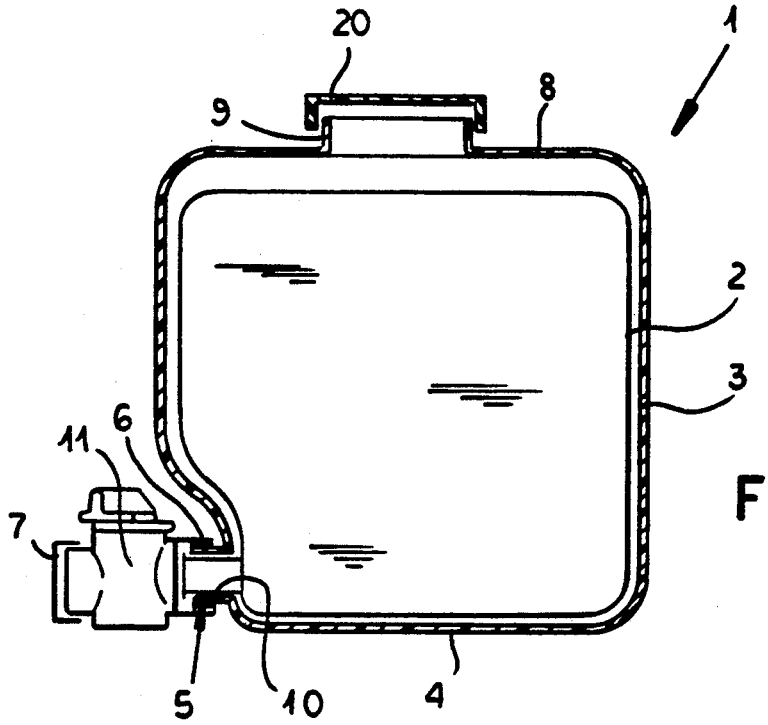
FIG. 2 is a similar view of the embodiment of FIG. 1 showing the inner container or sack in the filled state.

The outer diameter also has an upper wall or lid 8 formed with a large diameter aperture 9 which is of a large caliber in relation to the diameter of the outlet pipe spigot 5 and which is formed with a collar which can be closed by a cover or cap such as the cap 20 shown in FIG. 2.

The sack 2 can be inserted through the aperture 9 in its collapsed state (FIG. 1) and a hose spigot 10, which is relatively flexible, can be fitted through the outlet pipe spigot 5.

The sack 2 can be filled with the flowable material and, when filled, is supported against the outer container 1. Thus under the influence of gravity to which the filling may be subject, the sack 2 rests upon the base 4 of the outer container and bears outwardly against the walls from the outer surface 3 of the outer container 1.

Figure 6:
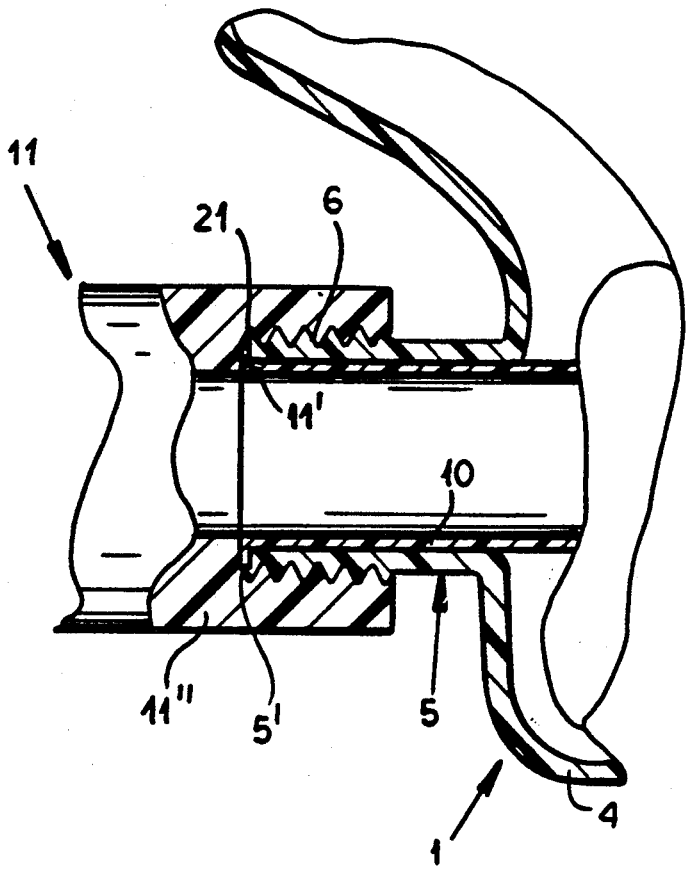
FIG. 6 is a detail view, in cross section, of the connection of the valve to the spigots.

As can be seen from FIG. 6, the hose connection 10 may have an outwardly turned portion 21 adapted to bear against the outer edge 5' of the outlet pipe spigot 5 and can be clamped against this outer edge by a shoulder 11' of the internally threaded fitting 11'' from part of the valve or cock 11.

Thus the hose connection 10 is secured to the outer edge of the outlet pipe spigot 5 and be means of the valve 11 can be closed and opened for emptying.

Figure 3:
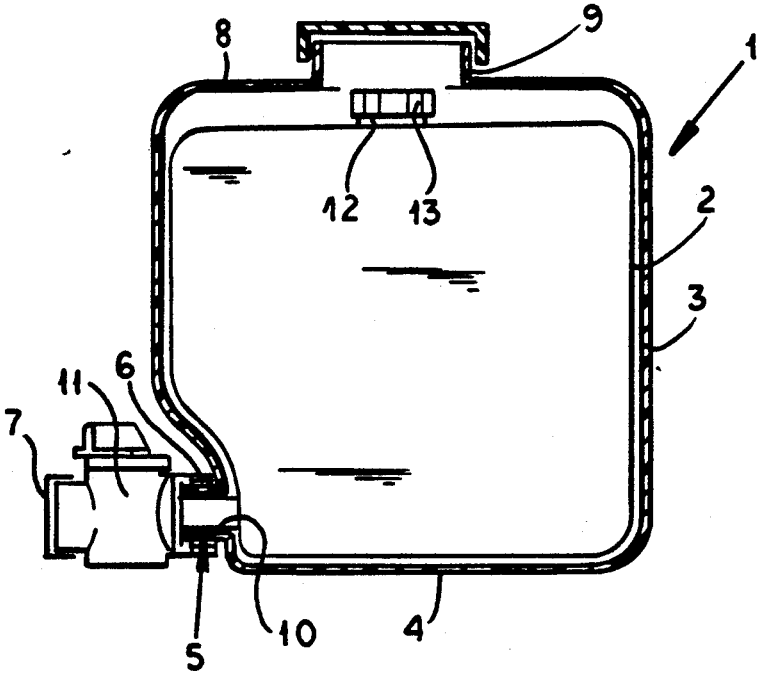
FIG. 3 is a view similar to FIG. 2 illustrating another embodiment of the invention.
Figure 5:
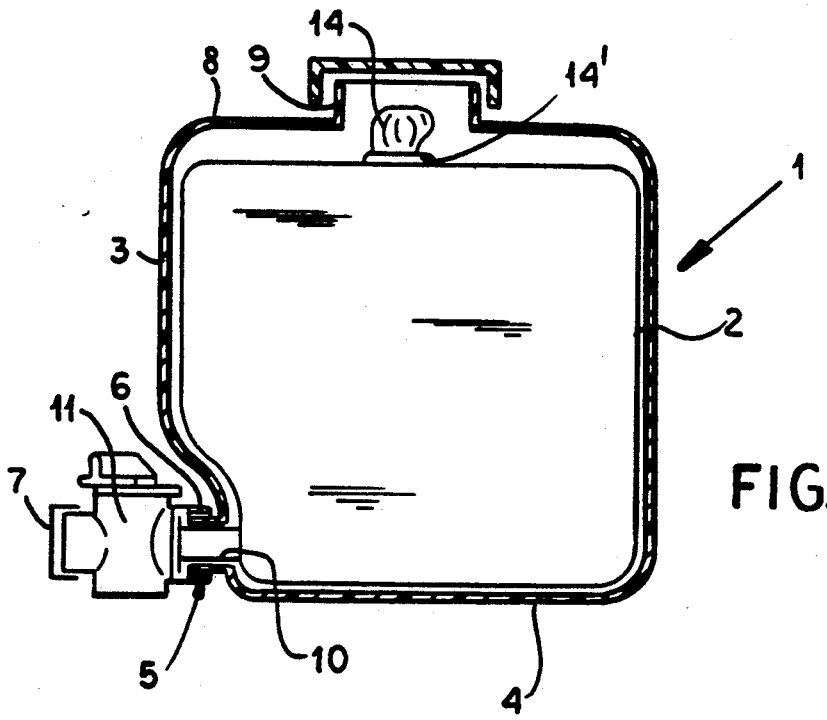
FIG. 5 is a view similar to FIG. 4 showing the embodiment thereof with its sack in the filled state.

From FIGS. 2, 3 and 5, it will be apparent that the inner container or sack, when filled, is completely separate from the aperture 9 or the lid and, indeed, there are no attachments to the walls of the outer container which come under stress and which may, therefore, tear away.

In the embodiment of FIGS. 1 and 2, the sack has only a single aperture in the form of the hose spigot received in the outlet pipe spigots. For filling purposes the sack 2 is rolled up and disposed in the outer container in its collapsed and substantially evacuated state. It is filled through the outlet pipe spigot 5 and the hose spigot 10.

Alternatively, the inner container may have a cap 13 closing a filling aperture and which can register with the aperture 9 and, when opened, can allow filling of the inner container. However, this cap is closed once the inner container is filled. Alternatively, the cap 13 can be provided for an aperture which can be used for emptying if, for some reason, emptying is desired in a different manner. Otherwise the container of FIG. 3 is filled in the manner described in connection with FIGS. 1 and 2.

Figure 4:
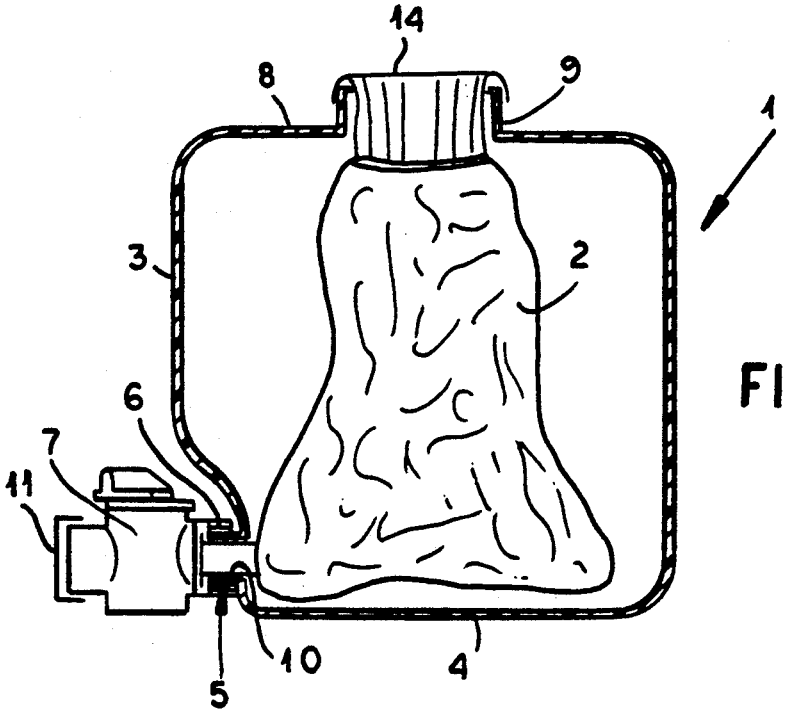
FIG. 4 is a vertical section corresponding to FIG. 1 illustrating with another embodiment and illustrating the condition of the sack as it is about to be filled.

In the embodiment shown in FIGS. 4 and 5, the sack 3 has a top filling aperture 14 which is connected to the container lid aperture 9 for filling of the sack. The aperture 14, of course, is then closed and separated from the aperture 9 (compare FIGS. 4 and 5). An appropriate tie represented only by the ring 14' in FIG. 5 represents the closure of the opening 14. Of course, suitable auxiliary means (not shown) can be used to introduce the sack 2 into the container 1.

We claim:

1. A container assembly for the transportation, storage and dispensing of a flowable material, comprising:

an outer load-bearing container composed of thermoplastic material and formed with an upper wall having a large-caliber closable aperture affording access into an interior of the outer container, lateral wall means around said interior, a base for said outer container and an outlet pipe spigot formed on said lateral wall means near said base, said outlet pipe spigot being formed with an external screwthread;

an inner container in the form of a collapsible flexible-wall sack composed of a plastic sheet material received in said interior of said outer container and formed with a hose spigot extending through said outlet pipe spigot and secured to an outer edge of said outlet pipe spigot, said sack being fillable with said material and, when filled, conforming to the configuration of said outer container, said sack having a top-filling aperture temporarily connectable to said large-caliber closable aperture in said upper wall of said outer container and including means for closing and detaching from said top-filling aperture, said container when at least partially filled being free from connection to said large-caliber closable aperture and said upper wall; and a valve threaded onto said outlet pipe spigot for opening and closing flow through said hose spigot.

2. The assembly defined in claim 1 wherein said valve is constructed and arranged to sealingly clamp said hose spigot against said edge.

* * * * *